US009945619B2

(12) United States Patent
Cho

(10) Patent No.: US 9,945,619 B2
(45) Date of Patent: Apr. 17, 2018

(54) WAVE FINS

(75) Inventor: Yong Kuk Cho, Busan-si (KR)

(73) Assignee: KORENS CO., LTD., Yangsan-si (KR)

( * ) Notice: Subject to any disclaimer, the term of this patent is extended or adjusted under 35 U.S.C. 154(b) by 555 days.

(21) Appl. No.: 14/357,584

(22) PCT Filed: Feb. 17, 2012

(86) PCT No.: PCT/KR2012/001208
§ 371 (c)(1),
(2), (4) Date: May 12, 2014

(87) PCT Pub. No.: WO2013/081249
PCT Pub. Date: Jun. 6, 2013

(65) Prior Publication Data

US 2014/0360707 A1 Dec. 11, 2014

(30) Foreign Application Priority Data

Nov. 29, 2011 (KR) ..... 10-2011-0125953

(51) Int. Cl.
*F28F 3/02* (2006.01)
*F28F 1/12* (2006.01)
*F28F 13/06* (2006.01)
*F28F 13/12* (2006.01)

(52) U.S. Cl.
CPC ..... *F28F 3/025* (2013.01); *F28F 1/126* (2013.01); *F28F 13/06* (2013.01); *F28F 13/12* (2013.01)

(58) Field of Classification Search
CPC .... F28F 1/126; F28F 1/40; F28F 13/02; F28F 13/06
USPC ..... 165/109.1, 152, 181, 183
See application file for complete search history.

(56) References Cited

U.S. PATENT DOCUMENTS 2,252,211 A * 8/1941 Seemiller ..... F28F 1/126 165/151
5,623,989 A * 4/1997 Kroger ..... F28F 1/32 165/152
5,625,229 A * 4/1997 Kojima et al. ..... F28F 3/025 257/712
6,390,188 B1 * 5/2002 Chen ..... H01L 23/467 165/185
7,040,386 B2 * 5/2006 Shimoya et al. ..... F28F 1/022 165/153

(Continued)

FOREIGN PATENT DOCUMENTS

JP 2004-177061 6/2004
KR 1020050080834 8/2005

*Primary Examiner* — Allen Flanigan
(74) *Attorney, Agent, or Firm* — Lex IP Meister, PLLC

(57) ABSTRACT

Wave fins which are disposed inside a heat exchanger housing of a heat exchanger in order to cause a turbulent flow of fluid through direct contact with the fluid. The wave fins include a plurality of hills, a plurality of valleys and a plurality of sidewalls. The hills and valleys are connected to each other via the plurality of sidewalls. The sidewalls partition fluid passages between the hills and the valleys through which fluid passes. The hills, the valleys and the sidewalls form main waveforms that extend in a longitudinal direction so as to be waved in a first radius of curvature. One or more bent portions are formed on intermediate portions of the main waveforms, the bent portions being connected to remaining portions of the main waveforms so as to be bent at a second radius of curvature.

5 Claims, 10 Drawing Sheets

(56) References Cited

U.S. PATENT DOCUMENTS

| | | | | |
|---|---|---|---|---|
| 7,614,443 | B2 * | 11/2009 | Usui et al. | F28D 7/1684 165/177 |
| 2004/0050538 | A1 * | 3/2004 | Sunder et al. | F25J 5/002 165/133 |
| 2004/0261984 | A1 * | 12/2004 | Derosier | F28F 1/32 165/151 |
| 2006/0048921 | A1 * | 3/2006 | Usui et al. | F28D 7/1684 165/109.1 |
| 2006/0289152 | A1 * | 12/2006 | Leuschner et al. | F28D 9/0062 165/152 |
| 2009/0025916 | A1 * | 1/2009 | Meshenky et al. | B21D 13/08 165/151 |
| 2009/0199585 | A1 * | 8/2009 | Ogawa et al. | F28D 1/0477 62/324.2 |

* cited by examiner

[Fig. 1]
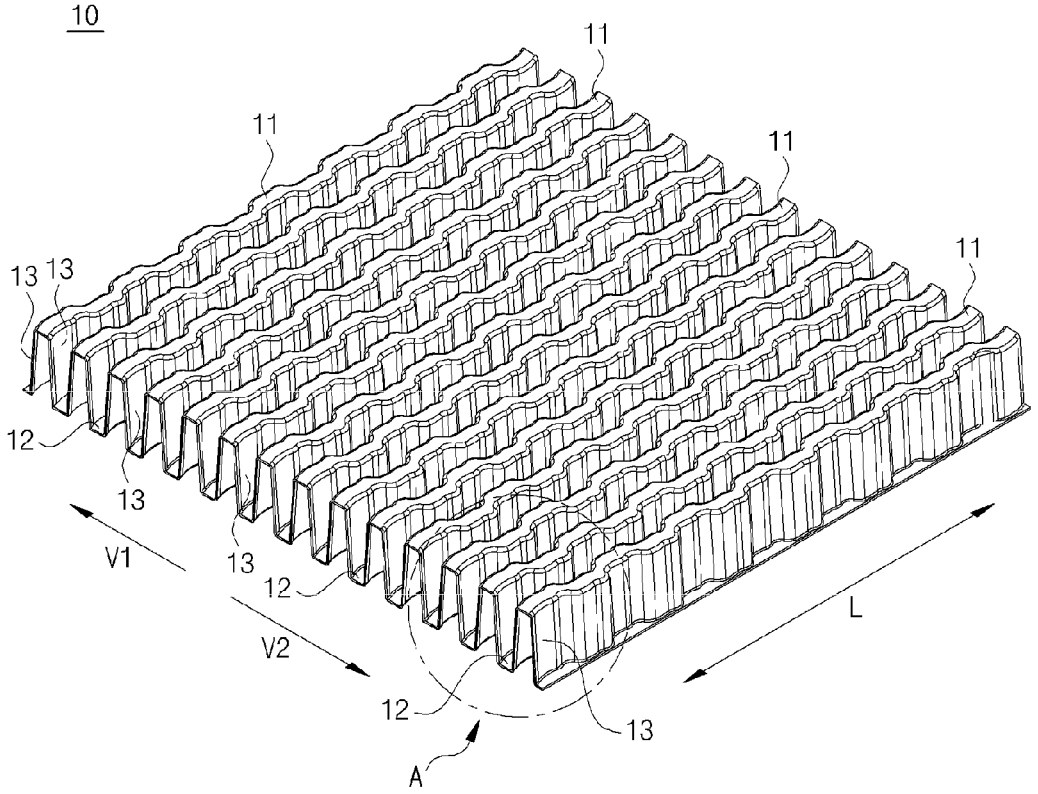

[Fig. 2]
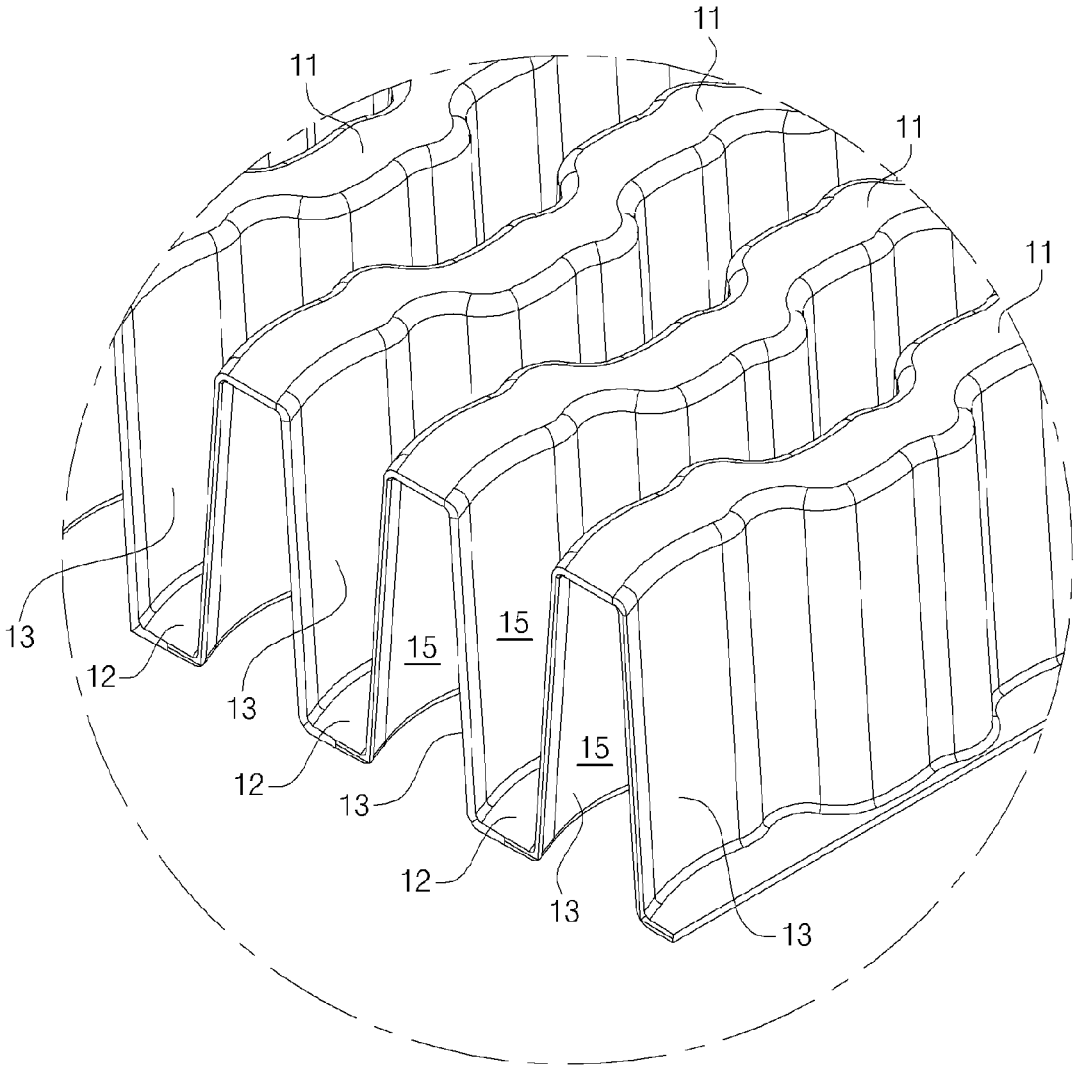

[Fig. 3]
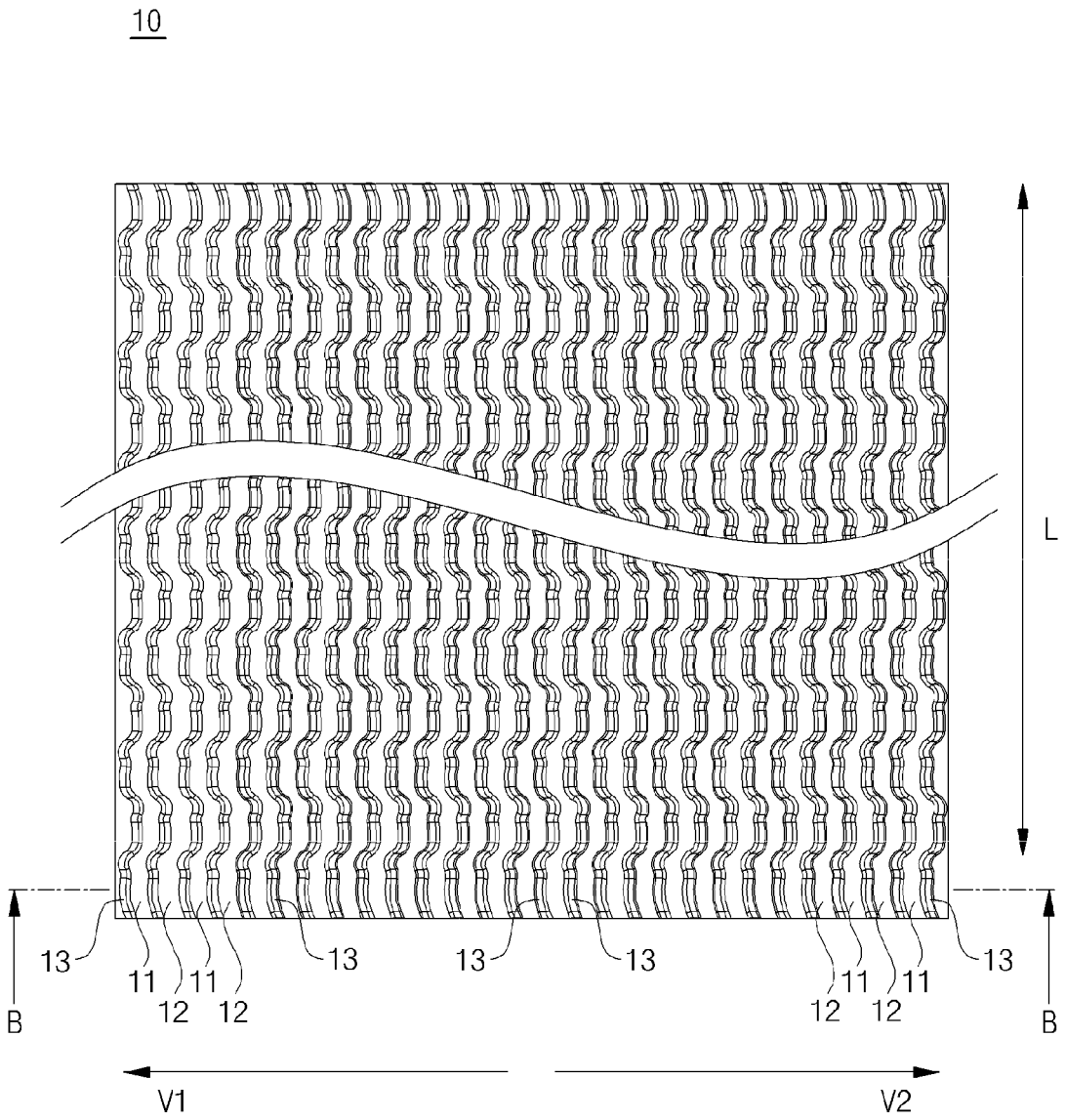

[Fig. 4]
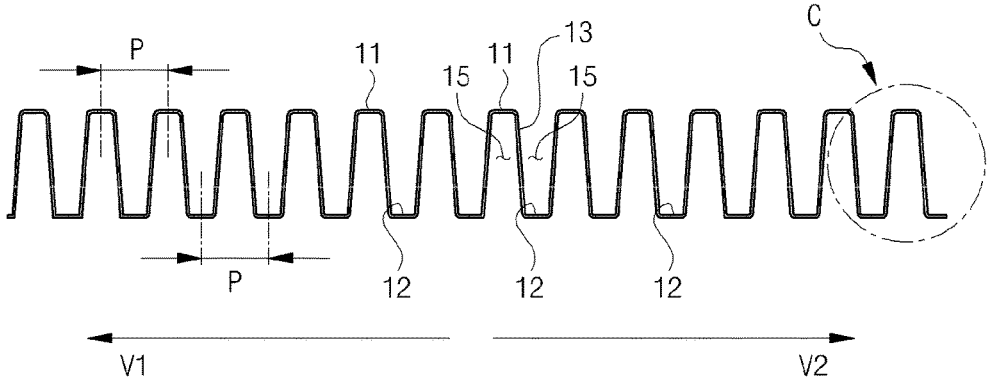

[Fig. 5]
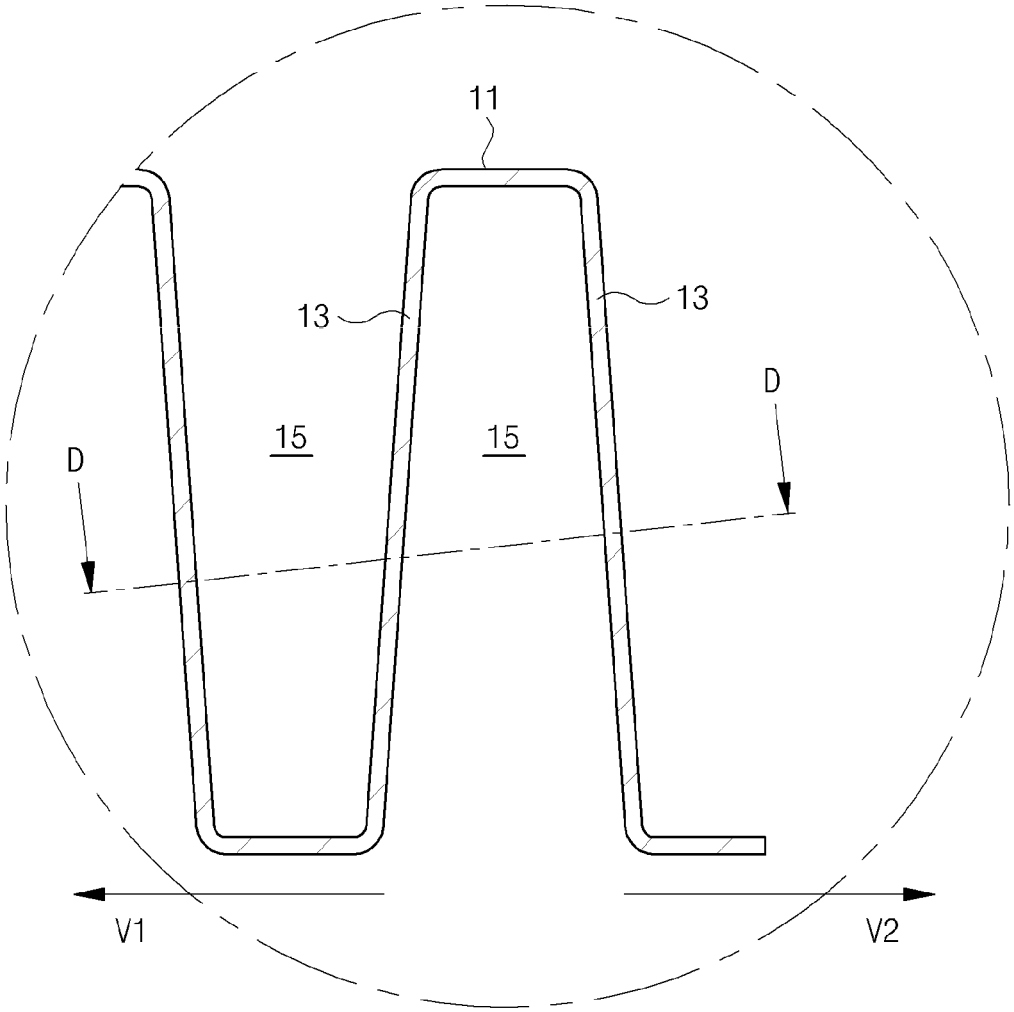

[Fig. 6]
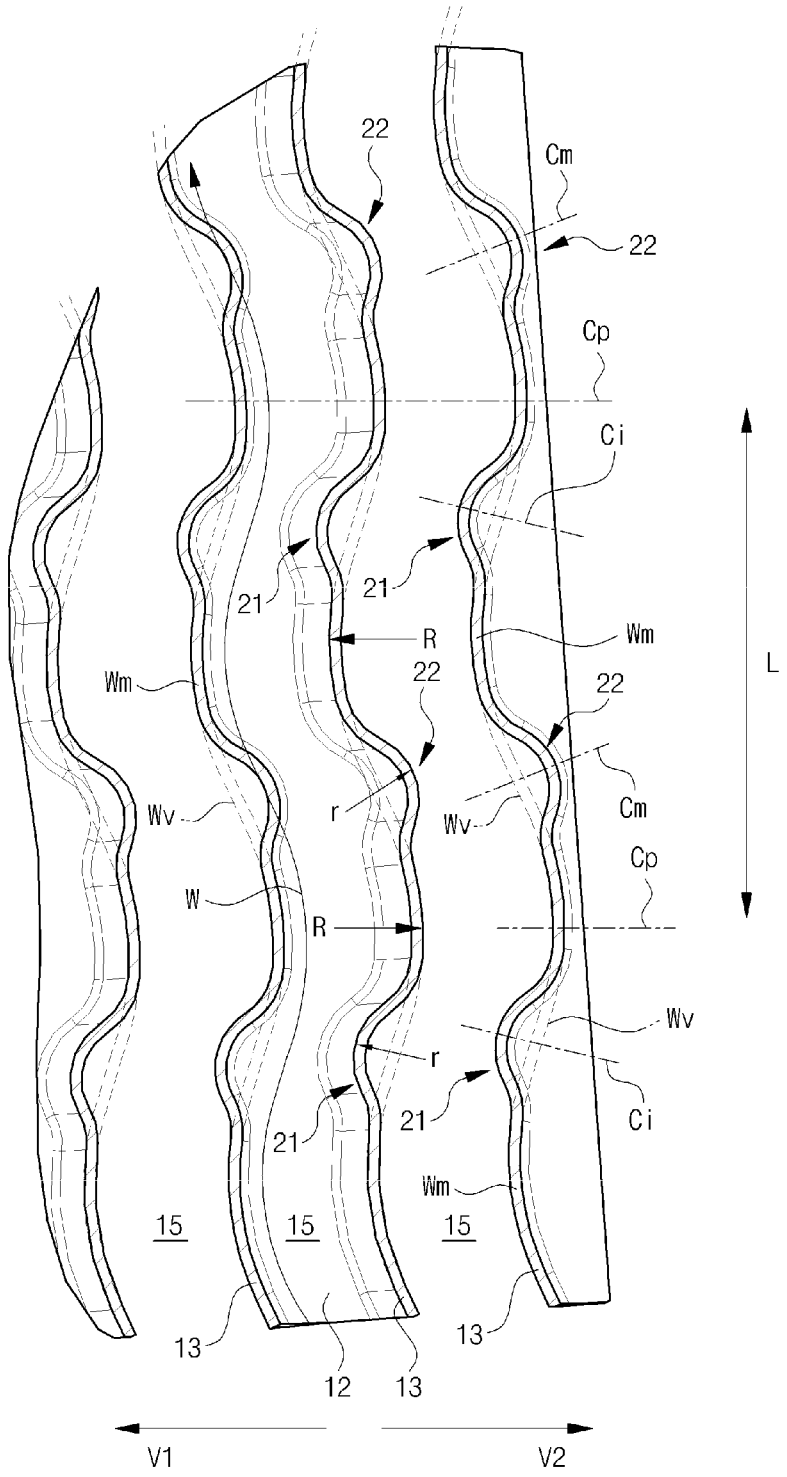

[Fig. 7]
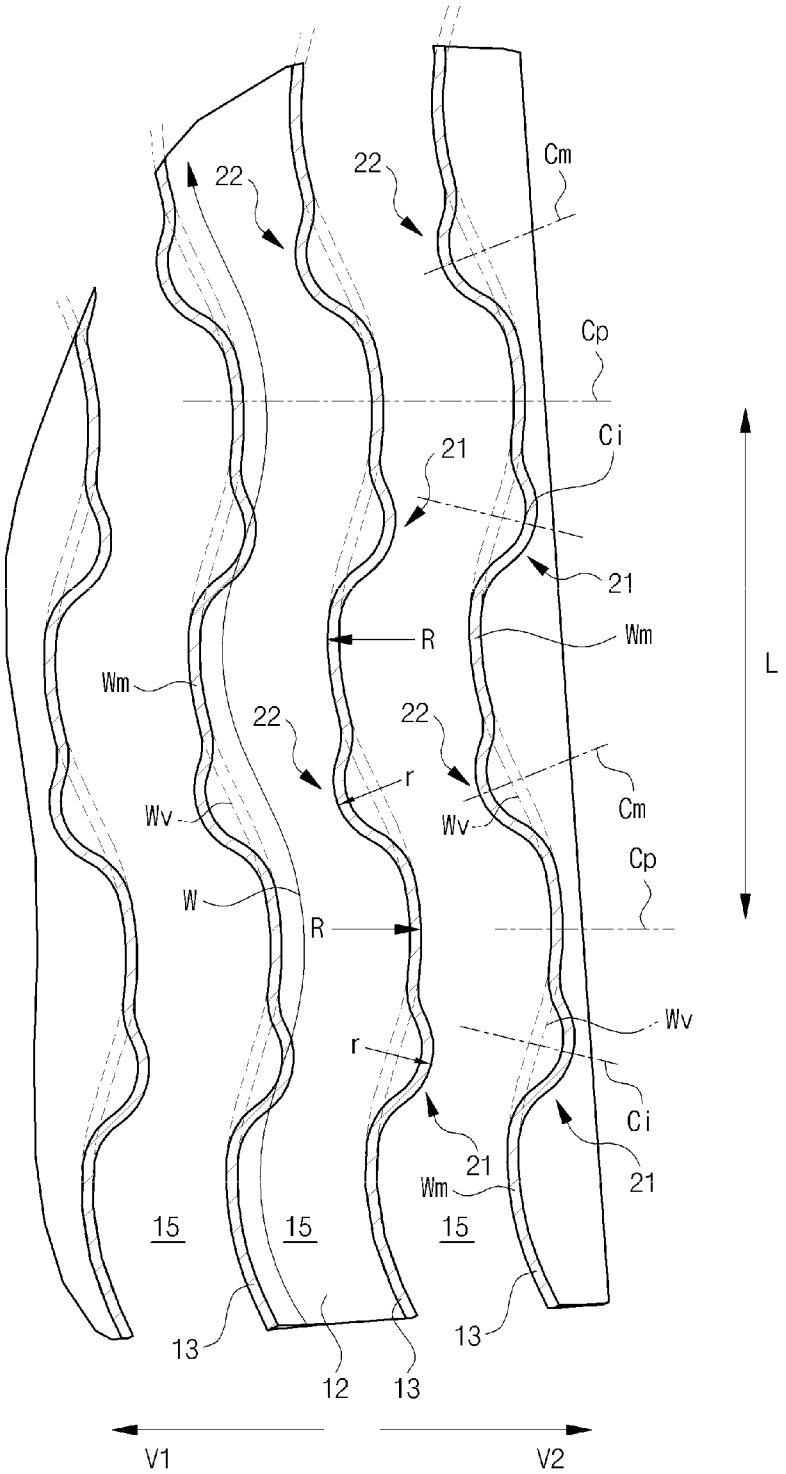

[Fig. 8]
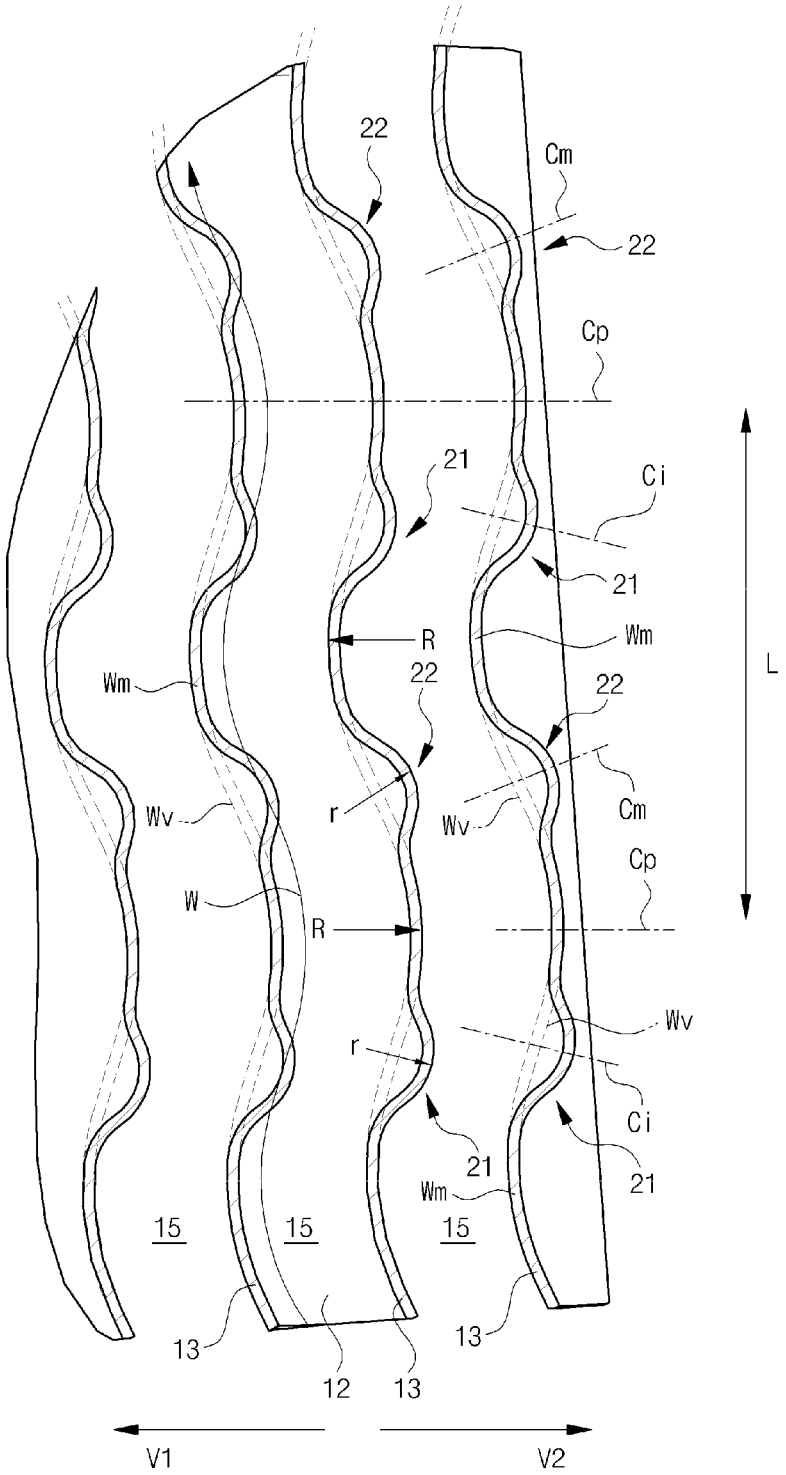

[Fig. 9]
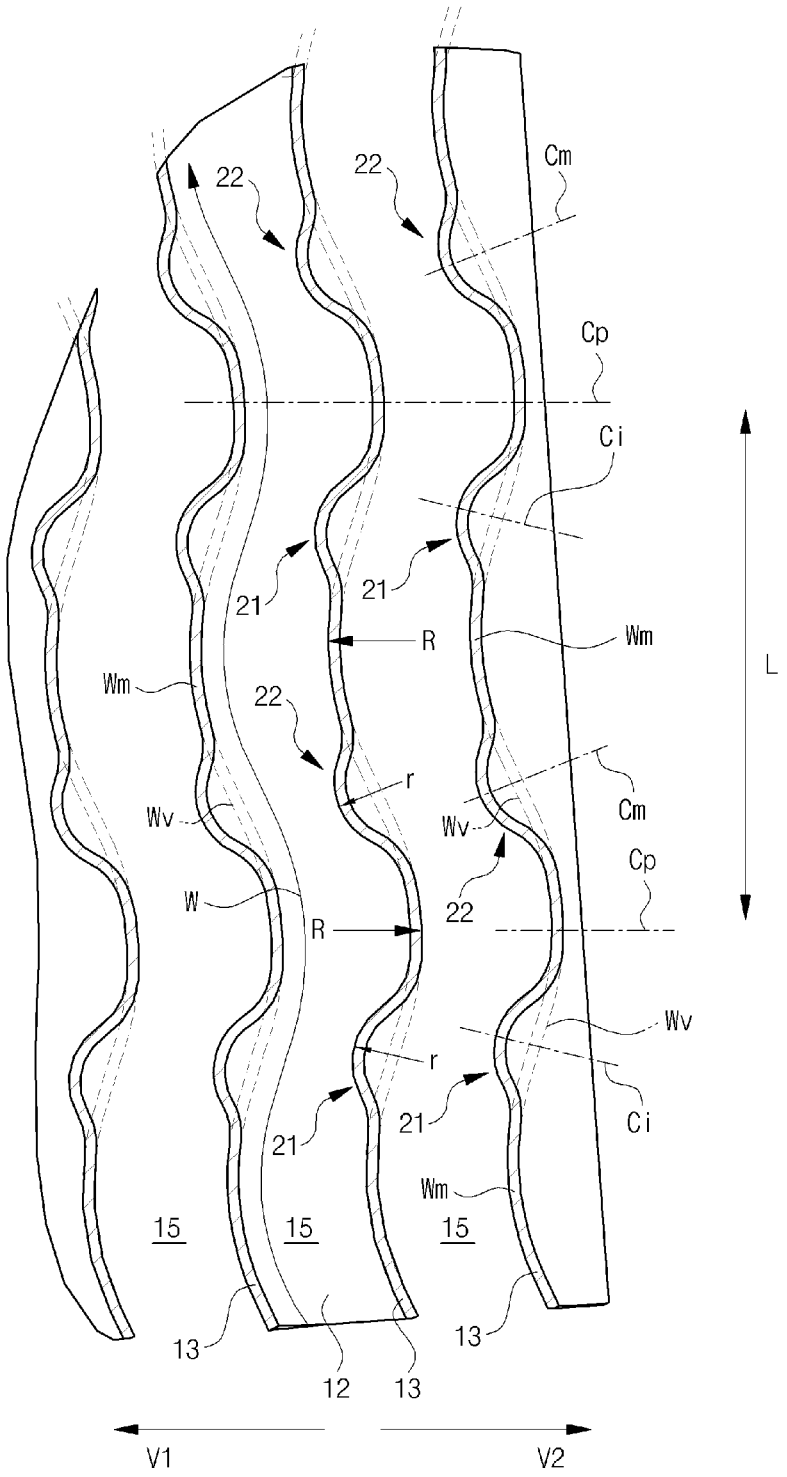

[Fig. 10]
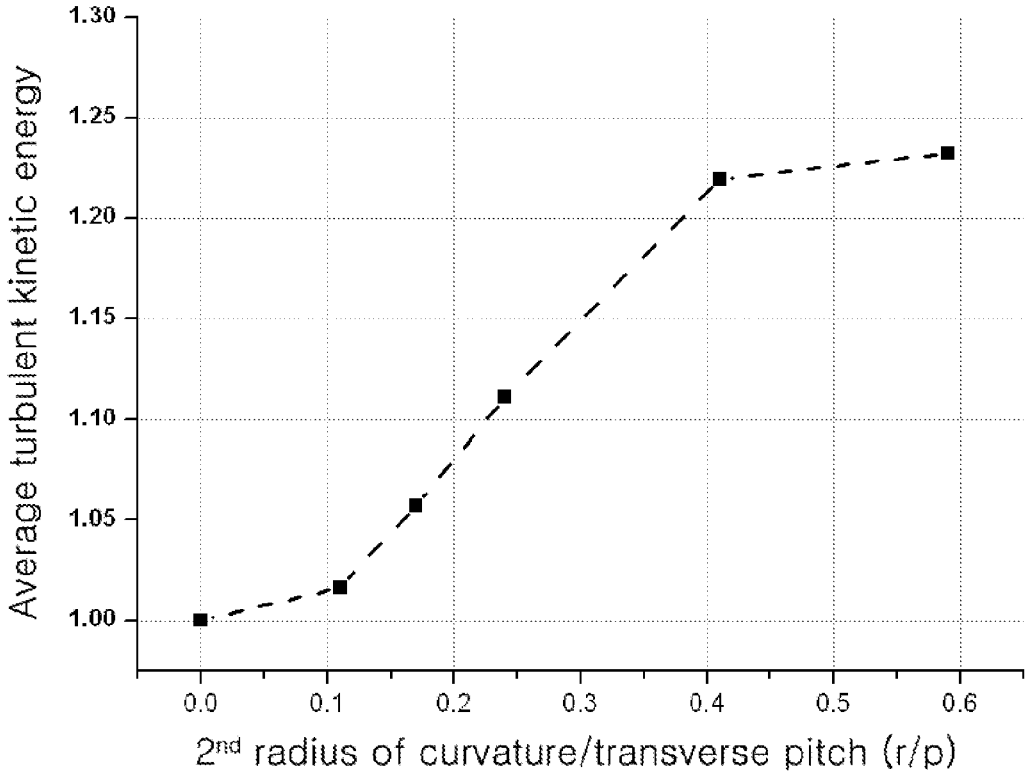

WAVE FINS

TECHNICAL FIELD

The present invention relates to wave fins which are disposed inside a heat exchanger housing of a heat exchanger in order to cause a turbulent flow of fluid through direct contact with the fluid, and more particularly, to wave fins which can promote the tendency of fluid to become turbulent and effectively improve the heat exchange efficiency of the fluid by significantly increasing the turbulent energy of the fluid.

BACKGROUND ART

A variety of heat exchangers, including an exhaust gas cooler for a vehicle such as an exhaust gas recirculation (EGR) cooler for recycling exhaust gas, a fuel cooler, an oil cooler, an intercooler, a superheater of a waste heat recovery system and a boiler, is used. Heat exchangers are configured to exchange heat between various types of fluid, such as gas-gas, liquid-gas and liquid-liquid. For instance, EGR can extract a portion of exhaust gas from an exhaust system of a diesel engine, circulate the extracted portion of exhaust gas through an intake system of the diesel engine, and add the extracted portion of exhaust gas to mixture gas, thereby reducing the production of nitrogen oxides (NOx). EGR can also realize many beneficial effects, such as a reduction in a pump loss, a reduction in the heat loss of coolant depending on the temperature drop of exhaust gas, an increase in a specific heat ratio depending on the amount of working gas and variations in composition, and resultant improvements in a cycle efficiency. Therefore, EGR is widely used as a method available for purifying exhaust gas and improving heat efficiency in a diesel engine.

Such a heat exchanger includes a heat exchanger housing through which fluid that is to be subjected to heat exchange passes and fin structures which are disposed inside the heat exchanger housing. The fin structures can improve the heat exchange efficiency of the fluid by inducing the fluid to become turbulent.

Such fin structures have a variety of shapes, such as a corrugated structure, a flat panel structure, a wave structure, or the like. Wave fin structures are recently popular considering their ability to improve heat exchange efficiency by promoting the tendency of fluid to become turbulent.

Wave fins are configured such that a plurality of hills and a plurality of valleys are repeatedly arranged in the transverse direction and are waved in the longitudinal direction, i.e. the direction in which fluid flows, thereby forming a plurality of partitioned fluid passages. This consequently allows the fluid that passes through the fluid passages of the wave fins to flow through the waved structure in the waved direction, thereby causing the fluid to become turbulent and circulate.

However, since the heat exchanger housing has a relatively small interior volume, there are several limitations against the ability of conventional wave fins to enhance the turbulence of fluid. In particular, since the surface of the conventional wave fins is smooth, the turbulent kinetic energy of fluid that passes through individual fluid passages is not substantially enhanced. In addition, a loss in kinetic energy occurs while fluid is flowing. Accordingly, the heat exchange efficiency of fluid is not substantially high, which is problematic.

DISCLOSURE

Technical Problem

Accordingly, the present invention has been made keeping in mind the above problems occurring in the prior art, and an object of the present invention is to provide wave fins which can enhance the turbulence of fluid and effectively and significantly increase the heat exchange efficiency of fluid by significantly increasing the turbulent energy of the fluid additionally causing a turbulent flow or an eddy in the direction of main waveforms in which the fluid flows.

Technical Solution

In order to accomplish the above object, the present invention provides wave fins that include a plurality of hills, a plurality of valleys and a plurality of sidewalls. The plurality of hills and the plurality of valleys being connected to each other via the plurality of sidewalls, and the plurality of sidewalls partition a plurality of fluid passages between the plurality of hills and the plurality of valleys through which fluid passes. The plurality of hills, the plurality of valleys and the plurality of sidewalls form main waveforms that extend in a longitudinal direction, the main waveforms extending so as to be waved in a first radius of curvature. One or more bent portions are formed on intermediate portions of the main waveforms, the bent portions being connected to remaining portions of the main waveforms so as to be bent at a second radius of curvature.

The second radius of curvature may be smaller than the first radius of curvature.

The bent portions may be respectively formed at positions that are symmetrical about respective vertex centerlines of the main waveforms, thereby forming a plurality of bent portions on intermediate portions of the main waveforms.

The plurality of bent portions may include a plurality of first bent portions which protrude from the main waveforms in a first transverse direction and a plurality of second bent portions which protrude from the main waveforms in a second transverse direction. The plurality of first bent portions and the plurality of second bent portions are formed at positions that are symmetrical about respective pitch centers of the main waveforms.

The plurality of bent portions may protrude from the main waveforms in at least one of first and second transverse directions.

Vertex centerlines of the plurality of first and second bent portions may be inclined with respect to the vertex centerlines of the main waveforms.

Portions where the plurality of hills and the plurality of sidewalls are respectively connected to each other may be formed to correspond to the bent portions. Portions where the plurality of valleys and the plurality of sidewalls are respectively connected to each other may be formed to correspond to the bent portions.

The ratio between a transverse pitch and a second radius of curvature of the wave fins may range from 0.1 to 0.6.

The cross-sectional shape of each of the plurality of fluid passages may be one selected from among a rectangle, a trapezoid and a circle.

Advantageous Effects

According to the present invention, the bent portions formed on the sidewalls accelerate the tendency of fluid to become turbulent, thereby significantly increasing turbulent kinetic energy. This consequently improves the heat exchange efficiency of the fluid, which is advantageous.

DESCRIPTION OF DRAWINGS

FIG. 1 is a perspective view showing wave fins according to an embodiment of the present invention.

FIG. 2 is an enlarged view of part A in FIG. 1.

FIG. 3 is a top plan view showing the wave fins according to an embodiment of the present invention.

FIG. 4 is a cross-sectional view taken along line B-B in FIG. 3.

FIG. 5 is an enlarged view of part C in FIG. 4.

FIG. 6 is a top-plan cross-sectional view taken along line D-D in FIG. 5.

FIG. 7 is a top-plan cross-sectional view showing a first modified embodiment of that shown in FIG. 6.

FIG. 8 is a top-plan cross-sectional view showing a second modified embodiment of that shown in FIG. 6.

FIG. 9 is a top-plan cross-sectional view showing a third modified embodiment of that shown in FIG. 6.

FIG. 10 is a graph showing average values of turbulent kinetic energy when fluid passes through wave fins according to the present invention.

MODE FOR INVENTION

Hereinafter an exemplary embodiment of the present invention will be described in detail in conjunction with the accompanying drawings.

FIGS. 1 to 6 are views showing wave fins according to an embodiment of the present invention.

As shown in the figures, the wave fins 10 according to the present invention include a plurality of hills 11 and a plurality of valleys 12 which continuously extend at preset distances along transverse directions V1 and V2 of the wave fins 10. The plurality of hills 11 is connected to the plurality of valleys 12 via a plurality of sidewalls 13 in the transverse direction.

The wave fins 10 have a plurality of fluid passages 15 which are partitioned by the plurality of sidewalls 13. The upper ends and lower ends of the fluid passages 15 are alternately closed by the plurality of hills 11 and the plurality of valleys 12.

As shown in FIGS. 4 and 5, each of the fluid passages 15 may form a trapezoidal cross-sectional structure as the sidewalls 13 which face each other are symmetrically inclined. Alternatively, the fluid passages 15 may have a variety of cross-sectional structures such as a trapezoidal cross-sectional structure or a circular cross-sectional structure.

In addition, the plurality of hills 11, the plurality of valleys 12 and the plurality of sidewalls 13 extend in the longitudinal direction so as to form the shape of waves having a first radius of curvature R, thereby forming main waveforms Wm in the direction of waveform that is indicated by an arrow W in FIG. 6. The main waveforms Wm are waved a preset direction (see the arrow W in FIG. 6) including an imaginary connecting line (see Wv in FIG. 6).

One or more bent portions 21 and 22 are formed in the main waveforms Wm. The bent portions 21 and 22 are curved at a second radius of curvature r, and are connected to the remaining portions of the main waveforms Wm.

In particular, the plurality of bent portions 21 and 22 act as concaves and convexes on the surface of the main waveforms Wm since the second radius of curvature r is smaller than the first radius of curvature R. When the fluid flows on the surface of the main waveforms Wm in the direction of a waveform W, turbulent flows and eddies can be created at the bent portions 21 and 22.

The bent portions 21 and 22 may be formed at positions that are symmetrical about respective vertex centerlines Cp of the main waveforms Wm. Accordingly, the plurality of bent portions 21 and 22 may be formed between the remaining portions of the main waveforms Wm.

According to an embodiment of FIG. 6, the plurality of bent portions 21 and 22 may include the plurality of first bent portions 21 which are formed in the main waveforms Wm so as to protrude in the first transverse direction V1 (to the left in FIG. 6) and the plurality of second bent portions 22 which are formed in the main waveforms Wm so as to protrude in the second transverse direction V2 (to the right in FIG. 6). The first bent portions 21 and the second bent portions 22 are formed at positions that are symmetrical about the respective vertex centerlines Cp of the main waveforms Wm. As clearly seen in FIG. 6, the first and second bent portions 21, 22 are thus alternately disposed on the main waveform along the longitudinal flow direction (indicated by arrow L) such that each first bent portion 21 is located substantially medially between the symmetry axis (corresponding to vertex centerlines Cp) of a crest located immediately upstream of said first bent portion in the longitudinal flow direction, and the symmetry axis (unlabeled) of a trough located immediately downstream of said first bent portion, with each second bent portion 22 being located substantially medially between the symmetry axis of a trough located immediately upstream of said second bent portion and the symmetry axis of a crest located immediately downstream of said second bent portion.

It is preferred that the ratio between a transverse pitch P and the second radius of curvature r of the wave fins according to the present invention ranges from 0.1 to 0.6.

FIG. 10 is a graph showing average values of turbulent kinetic energy when wave fins according to the present invention are used. This graph shows values of turbulent kinetic energy depending on the ratio between the transverse pitch P and the second radius of curvature r of the bent portions 21 and 22 in the wave fins. The results are presented in Table 1 below.

TABLE 1

| Second radius of curvature r/transverse pitch P | Average kinetic energy (J/kg) | Ratio of average kinetic energy |
|---|---|---|
| 0 | 1.932 | 1 |
| 0.11 | 1.964 | 1.017 |
| 0.17 | 2.042 | 1.057 |
| 0.24 | 2.146 | 1.111 |
| 0.41 | 2.356 | 1.219 |
| 0.59 | 2.381 | 1.232 |

The ratio of an average value of turbulent kinetic energy refers to the ratio between an average value of turbulent kinetic energy about conventional wave fins (control group) without bent portions and an average value of turbulent kinetic energy about wave fins having bent portions according to the present invention.

This explains that the turbulent kinetic energy in the wave fins according to the present invention is significantly increased when the ratio between the transverse pitch P and the second radius of curvature r ranges from 0.1 to 0.6. It is apparent that, at the ratio smaller than 0.1, there are substantially no differences between the presence and absence of the bent portions 21 and 22 (there is substantially no increase in the turbulent kinetic energy). At a ratio greater than 0.6, the turbulent kinetic energy is stagnant without exceeding a value of 1.25. It can be appreciated that the turbulent kinetic energy in the wave fins 10 according to the present invention is optimized when the ratio between the transverse pitch P and the second radius of curvature r ranges from 0.1 to 0.6. A ratio smaller than 0.1 or greater than 0.6 is not preferable considering the ease of manufacture or an improvement in productivity since the turbulent kinetic energy exhibits substantially no increase or an increase in the turbulent kinetic energy is stagnant.

FIG. 7 is a top-plan cross-sectional view showing a first modified embodiment of that shown in FIG. 6. In this structure, the first bent portions 21 protrude in the second transverse direction V2, and the second bent portions 22 protrude in the first transverse direction V1.

FIG. 8 is a top-plan cross-sectional view showing a second modified embodiment of that shown in FIG. 6. In this structure, the first and second bent portions 21 and 22 protrude in the second transverse direction V2.

FIG. 9 is a top-plan cross-sectional view showing a third modified embodiment of that shown in FIG. 6. In this structure, the first and second bent portions 21 and 22 protrude in the first transverse direction V1.

The plurality of bent portions 21 and 22 are not limited to the configuration shown in FIG. 6 but can be configured to protrude in at least one transverse direction of the first and second transverse directions V1 and V2 on the main waveforms Wm.

The vertex centerlines Ci and Cm of the first and second bent portions 21 and 22 may be inclined with respect to the vertex centerline Cp of the main waveforms Wm. With this configuration, the first and second bent portions 21 and 22 may be connected to the remaining portions of the main waveforms Wm.

As shown in FIGS. 1 and 2, the portions where the hills 11 and the sidewalls 13 are connected to each other are formed to correspond to the bent portions 21 and 22, and the portions where the valleys 12 and the sidewalls 13 are connected to each other are formed to correspond to the bent portions 21 and 22.

The invention claimed is:

1. Wave fins comprising:

a plurality of hills, a plurality of valleys and a plurality of sidewalls, each hill, valley, and sidewall extending in a longitudinal flow direction and the plurality of hills and the plurality of valleys alternately arranged along a transverse direction perpendicular to the longitudinal flow direction, wherein the plurality of hills and the plurality of valleys being connected to each other via the plurality of sidewalls, and the plurality of sidewalls partition a plurality of fluid passages between the plurality of hills and the plurality of valleys through which fluid passes, wherein each of the plurality of fluid passages forms a periodic wave consisting of a main waveform that extends in the longitudinal flow direction and a plurality of bent portions periodically disposed in the main waveform, wherein the main waveform extends so as to be sinusoidally waved in a first radius of curvature, with the waveform defining alternating crests and troughs each having a symmetry axis about which the crest or trough is symmetrically shaped, wherein each of the bent portions is curved at a second radius of curvature, wherein the plurality of bent portions consist of a plurality of first bent portions which protrude from the main waveform in a first transverse direction and a plurality of second bent portions which protrude from the main waveform in a second transverse direction opposite of the first transverse direction, the plurality of first bent portions and the plurality of second bent portions are periodically alternate in the longitudinal direction with a distance therebetween, wherein the first and second bent portions are alternately disposed on the main waveform along the longitudinal flow direction such that each first bent portion is located substantially medially between the symmetry axis of a crest located immediately upstream of said first bent portion in the longitudinal flow direction, and the symmetry axis of a trough located immediately downstream of said first bent portion, with each second bent portion being located substantially medially between the symmetry axis of a trough located immediately upstream of said second bent portion and the symmetry axis of a crest located immediately downstream of said second bent portion, and wherein the plurality of fluid passages are arranged to repeat a same pattern in the first transverse direction and the second transverse direction.

2. The wave fins according to claim 1, wherein the second radius of curvature is smaller than the first radius of curvature.

3. The wave fins according to claim 1, wherein vertex centerlines of the plurality of first and second bent portions are inclined with respect to the symmetry axis of the crests and trough of the main waveform.

4. The wave fins according to claim 1, wherein a ratio between a transverse pitch of the main waveforms in the first and second transverse directions and the second radius of curvature ranges from 0.1 to 0.6.

5. The wave fins according to claim 1, wherein a cross-sectional shape of each of the plurality of fluid passages comprises one selected from the group of a rectangle, a trapezoid and a circle.

* * * * *